US005300910A

United States Patent [19]

Unkelbach et al.

[11] Patent Number: 5,300,910

[45] Date of Patent: Apr. 5, 1994

[54] MAGNET SYSTEM

[75] Inventors: Karl-Heinz Unkelbach, Cologne; Marlene Marinescu; Nicolae Marinescu, both of Frankfurt, all of Fed. Rep. of Germany

[73] Assignee: Klockner-Humboldt-Deutz Aktiengesellschaft, Cologne, Fed. Rep. of Germany

[21] Appl. No.: 804,778

[22] Filed: Dec. 9, 1991

[30] Foreign Application Priority Data

Dec. 10, 1990 [DE] Fed. Rep. of Germany ..... 4039320

[51] Int. Cl.[5] ..... H01F 7/02

[52] U.S. Cl. ..... 335/306; 335/302

[58] Field of Search ..... 335/306, 302

[56] References Cited

U.S. PATENT DOCUMENTS 4,538,130 8/1985 Gluckstern et al. ..... 335/306

*Primary Examiner*—Harold Broome

*Attorney, Agent, or Firm*—Charles L. Schwab

[57] ABSTRACT

In a known magnet system, specifically for magnetic separators, having homogeneously magnetized magnet blocks arranged in circular ring shape, the magnet blocks have their magnetization directions aligned differently from one to another and established in accordance with a predetermined mathematical formula. While a magnetic field running almost uniformly over the whole region of the magnet system is thus produced, the magnet blocks are made trapezoidal in cross section and, because of the many distinct magnetization directions, require separate fabrication. Both the fabrication and the assembly of these magnet blocks are therefore relatively complicated and time-consuming. In accordance with the invention, however, the fabrication and the assembly of the magnet blocks into a magnet system are quite substantially simplified and improved by virtue of the fact that the magnet blocks (1) are made square in cross section.

3 Claims, 7 Drawing Sheets

MAGNET SYSTEM

TECHNICAL FIELD

This invention relates to a magnet system, specifically for magnetic separators, having homogeneously magnetized magnet blocks arranged in circular ring shape, which magnet blocks have their magnetization directions aligned differently from one to another and established in accordance with a predetermined mathematical formula.

PRIOR ART STATEMENT

A magnet system having an outwardly directed magnetic field is known from German Offenlegungsschrift 36 37 200, in which magnet system the magnet blocks arranged in circular ring shape have their magnetization directions aligned differently from one to another and established in accordance with the mathematical formula $\psi i = -n\phi i$. The magnet blocks of this known magnet system are made trapezoidal in cross section and, in the assembly of these magnet blocks, care must therefore be taken that the magnetization direction of each individual magnet block corresponds to the result calculated for said magnet block in accordance with this formula. This known making and arrangement of the magnet blocks permits an optimal field strength distribution in the region outside the magnet blocks for the required number of poles in each case.

OBJECTS AND SUMMARY OF THE INVENTION

Starting from this known magnet system, the object of the invention consists in a further improvement or simplification of this magnet system, in particular with regard to fabrication and composition.

This object is achieved by virtue of the fact that the magnet blocks are made square in cross section. By virtue of the fact that the magnet blocks in accordance with the invention are made square in cross section, only two types differing in magnetization direction are required for the construction of an arbitrarily large ring-shaped magnet system, of which magnetization directions one desirably runs parallel to the side walls of the magnet blocks, while very many distinct blocks (e.g., 10) each having a different magnetization direction are necessary in the known magnet system having magnet blocks made trapezoidal in cross section. Thus, by virtue of the making of the magnet blocks in accordance with the invention, not only the fabrication of the magnet blocks but also the composition or the assembly of the magnet blocks into a ring-shaped magnet system are quite substantially simplified and facilitated, since upon assembly the magnet blocks need only be rotated in their position about their axis so that their magnetization direction corresponds to the direction of the mathematical formula $\psi i = \pm n\phi i$. In this position, the magnet blocks are then fastened to an appropriate foundation.

In further development of the invention, the magnet blocks have their magnetization directions aligned in accordance with the mathematical formula $\psi i = \pm n\phi i$. Upon construction of a magnet system having an outwardly directed magnetic field, the magnet blocks have their magnetization directions arranged in accordance with the mathematical formula $\psi i = -n\phi i$, while in a magnet system having an inwardly directed magnetic field, upon construction of the magnet system, the magnet blocks have their magnetization directions aligned in accordance with the mathematical formula $\psi i = +-n\phi i$.

In accordance with a further advantageous development of the invention, in order to enhance the magnetic field strength of the outwardly or inwardly directed magnetic field of a magnet system, the magnet blocks are arranged in two or a plurality of circular ring-shaped rows one behind another. Depending on the requirement of the desired enhancement of the magnetic field strength in each case, the magnet blocks of one row can very advantageously be made with an equally large or an unequally large cross section in comparison with the magnet blocks of the other row.

BRIEF DESCRIPTION OF THE DRAWINGS

Below, other details, features and advantages of the invention are explained in more detail on the basis of exemplary embodiments schematically illustrated in the figures of the drawing.

DETAILED DESCRIPTION OF THE DRAWINGS

Figure 1:
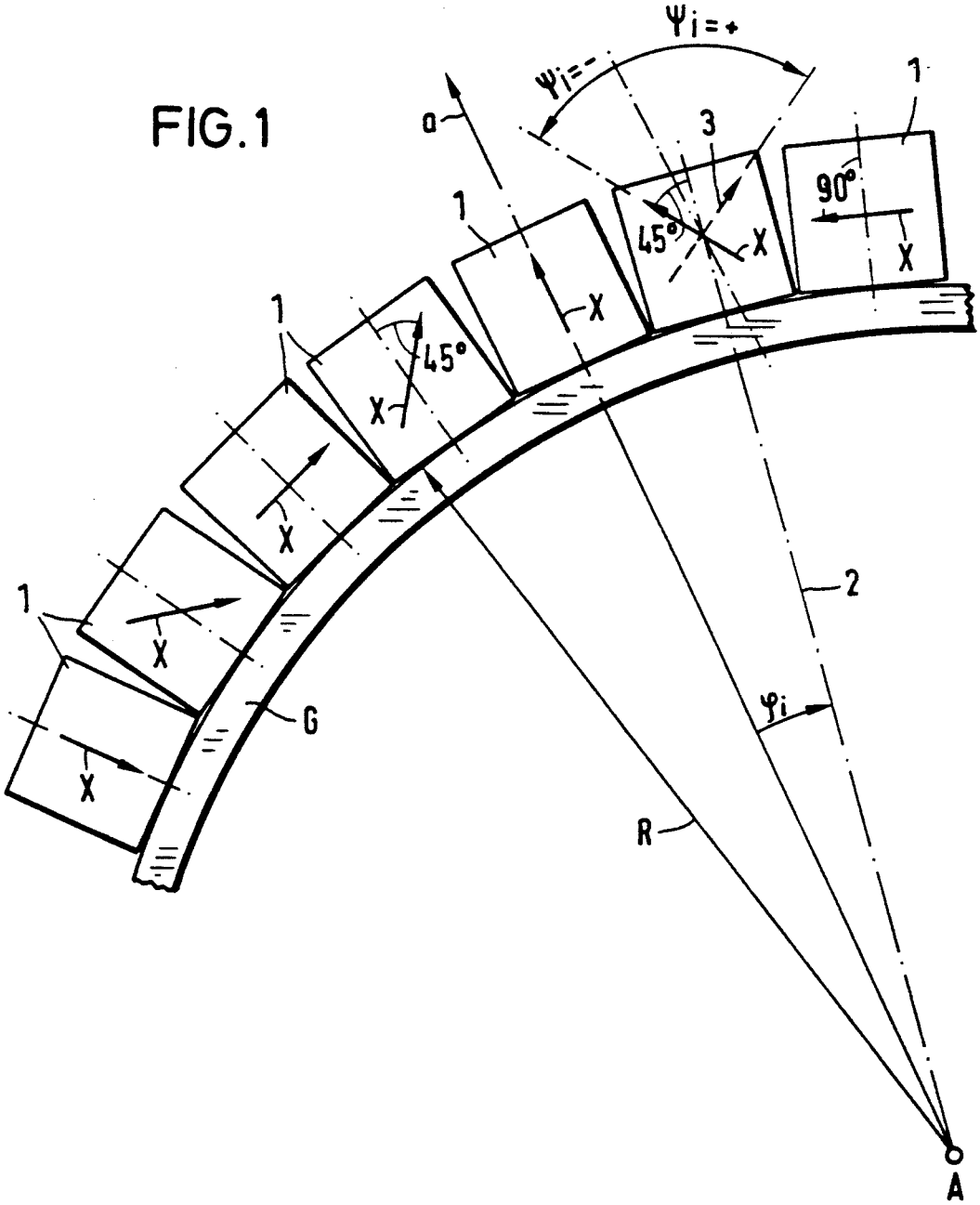
FIG. 1 shows a sectoral arrangement of a magnet system having seven magnet blocks, made square in cross section, having 90-degree and 45-degree magnetization directions (four blocks per pole).

As FIG. 1 shows, the magnet system consists of magnet blocks (1), made square in cross section, which are arranged in circular ring shape having radius (R) relative to the axis (A) of a magnetic drum separator. The magnet blocks (1) have their magnetization directions (arrows X) aligned differently from one to another and established in accordance with a predetermined mathematical formula and fixed on a cylindrical foundation (G). The arrangement of the magnet blocks (1) on the foundation (G) is such that the magnetization direction of the i-th magnet block (1) forms an angle $\psi i = -n\phi i$ with the zero angular position (a), where n is a positive number and $\phi i$ is the angle formed by the vertical line (2) joining the center of gravity of the i-th magnet block (where i is an index) with the rotation axis (A) of the drum of the magnetic separator and by an arbitrary predetermined established radius, and where $\psi i$ is to be reckoned in the same sense of rotation and starting from the same zero angular position (a) as $\phi i$. The radially inward facing face of the magnet blocks (1) are in substantially tangential relation to the cylindrical foundation (G).

The making of the magnet blocks (1) square in cross section in accordance with the invention has the special advantage that all magnet blocks can be fabricated in a unified fashion with only two magnetization directions, namely one magnetization direction running parallel to the side walls of the magnet blocks and one magnetization direction running diagonally inclined at 45° thereto. In the assembly of these magnet blocks (1) into a magnet system, the magnet blocks need only be rotated by 90° about their axis so that their magnetization directions (arrows X) correspond to the predetermined mathematical formula.

In the magnet system illustrated in FIG. 1, the magnet blocks (1) have their magnetization directions (arrow X) aligned in accordance with the mathematical formula $\psi i = -n\phi i$. By virtue of this alignment of the magnet blocks (1) in accordance with this formula, a magnetic field directed only outwardly and running almost uniformly over the whole region of the magnetic field is built up. If, however, an inwardly directed, almost uniformly running magnetic field is to be built up in a magnet system, the magnet blocks (1) need only have their magnetization directions (arrow 3) aligned in accordance with the mathematical formula $\psi i = +n\phi i$, which can be accomplished very easily by means of a simple rotation of the magnet blocks.

Figure 2:
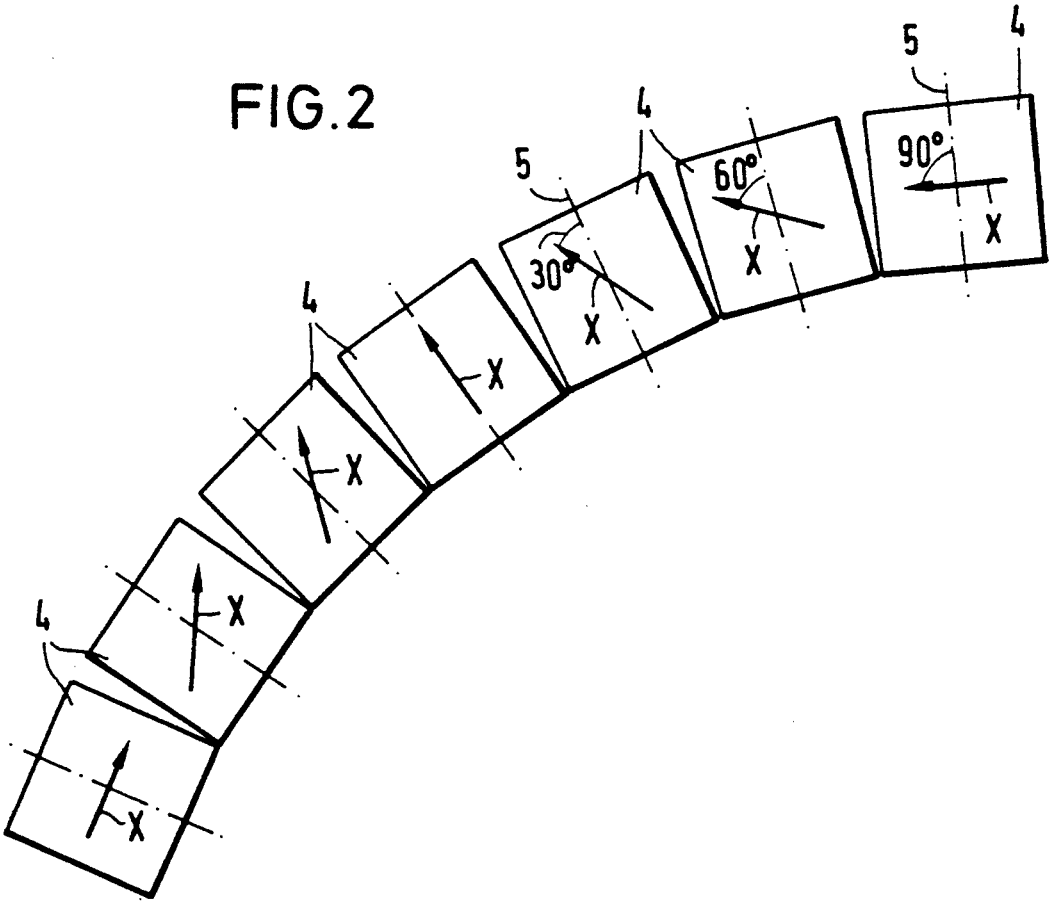
FIG. 2 shows a sectoral arrangement of a magnet system having seven magnet blocks, made square in cross section, having 90-degree and 60-degree magnetization directions (six blocks per pole).
Figure 3:
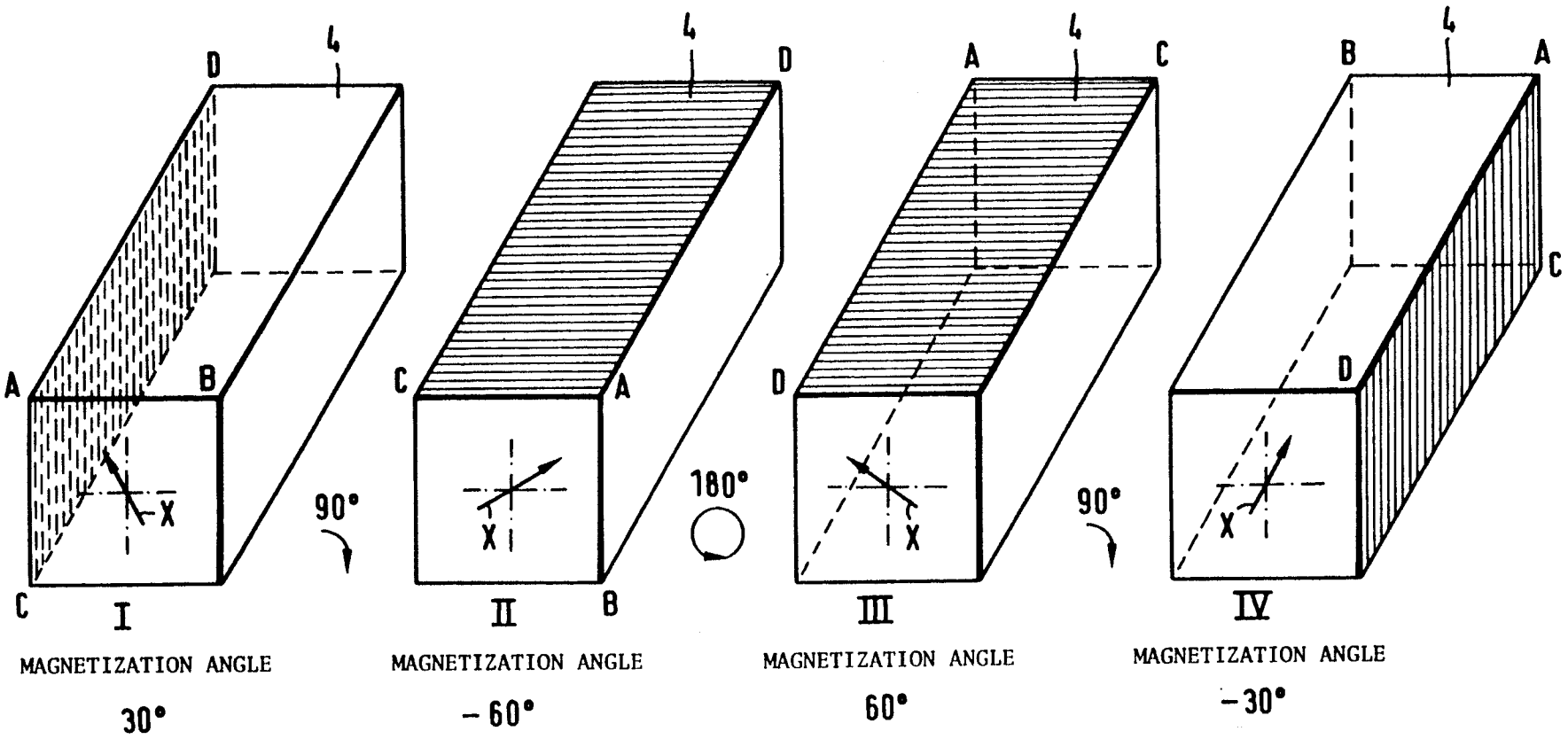
FIG. 3 shows a magnet block, made square in cross section, of a single magnetization direction but in four different positions with respect to the magnetization angle.

In the magnet system illustrated in FIG. 2, the magnet blocks (4) are likewise provided with only two distinct magnetization directions (X). Here, however, the magnetization directions (X) do not run inclined at 90° and 45° relative to the parallel side faces (5) of the magnet blocks, as in FIG. 1, but are aligned to run inclined at 90° and 60° or 30° to the parallel side faces (5). The way in which this magnet block arrangement relative to the magnetization directions, as illustrated in FIG. 2, is arrived at by means of simple rotation of the magnet blocks (4), is shown by means of a magnet block (4) rotated into different positions, illustrated in FIG. 3. Starting from the position (position I) of the magnet block (4) shown at left in FIG. 3, with the magnetization direction (X) inclined at 30° to the parallel side faces, a magnetization direction inclined at 60° relative to the parallel side faces (position II) is achieved by means of simple rotation of the block by 90° clockwise. A magnetization direction (X) of the magnet block inclined at 60° counterclockwise relative to the parallel side faces is achieved in a simple fashion by means of rotation of the magnet block in its longitudinal axis by 180°, into position (III) . And, finally, a magnetization direction (X) running inclined at 30° clockwise relative to the parallel side faces is achieved in turn by means of simple rotation of the magnet block by 90°, into position (IV). Thus, by means of simple rotation of the magnet blocks (4), having only two magnetization directions, namely by means of a 90-degree and a 60-degree magnetization direction, the magnet blocks (4) can very easily be assembled into a magnet system having an outwardly directed magnetic field, as shown in FIG. 2.

Figure 4:
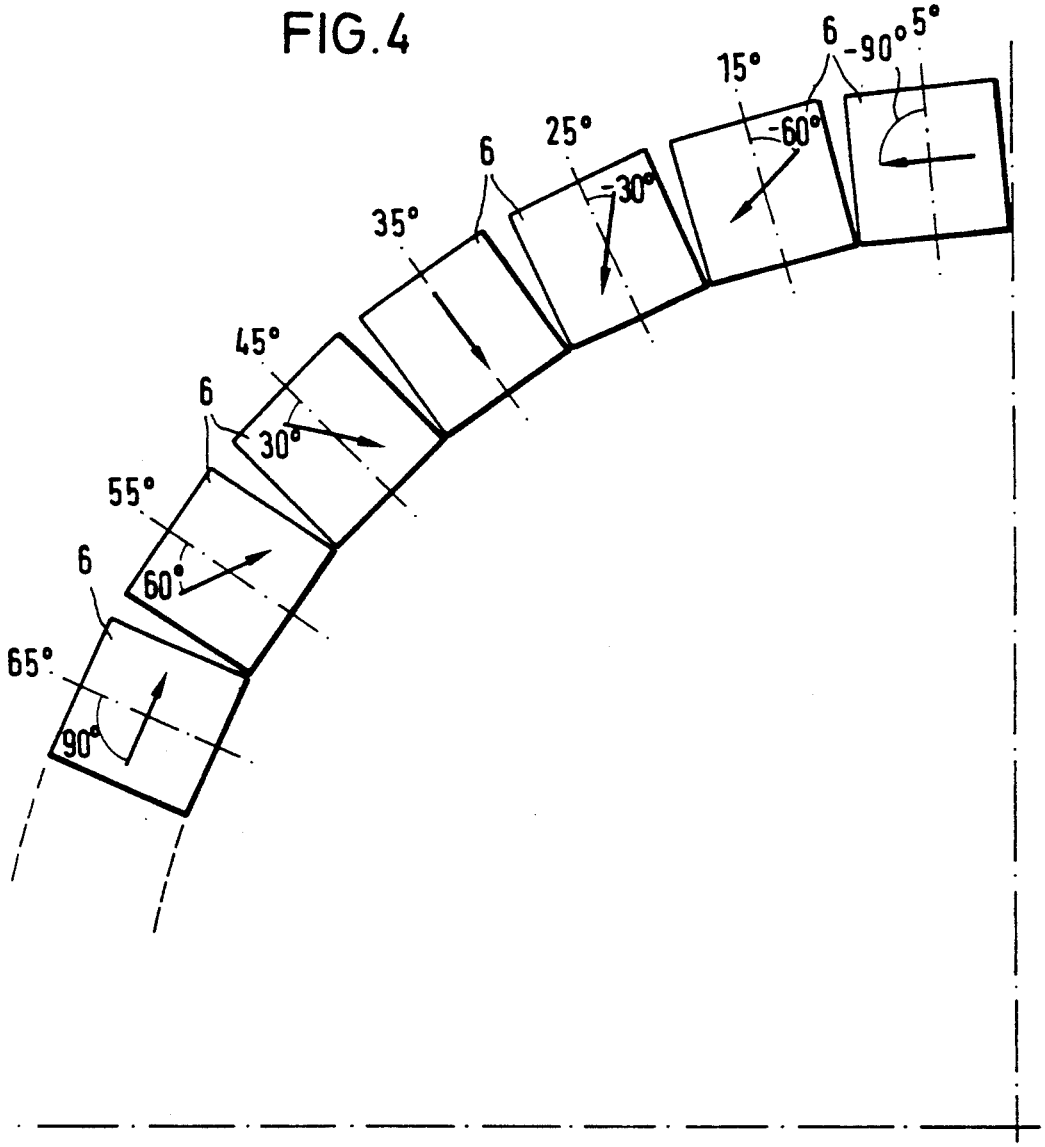
FIG. 4 shows a sectoral arrangement of a magnet system having seven magnet blocks, made square in cross section, and having an inwardly directed magnetic field (six blocks per pole).

FIG. 4 shows the arrangement of magnet blocks (6) in accordance with the invention, having an inwardly directed magnetic field. Here the arrangement of the magnet blocks (6) is such that they come to lie on a circular arc at an interval of 10 angular degrees between each two blocks. Here again, the sectoral or also circular ring-shaped arrangement of these magnet blocks (6) relative to the predetermined magnetization directions is achieved by means of simple rotation of the magnet blocks.

Figure 5:
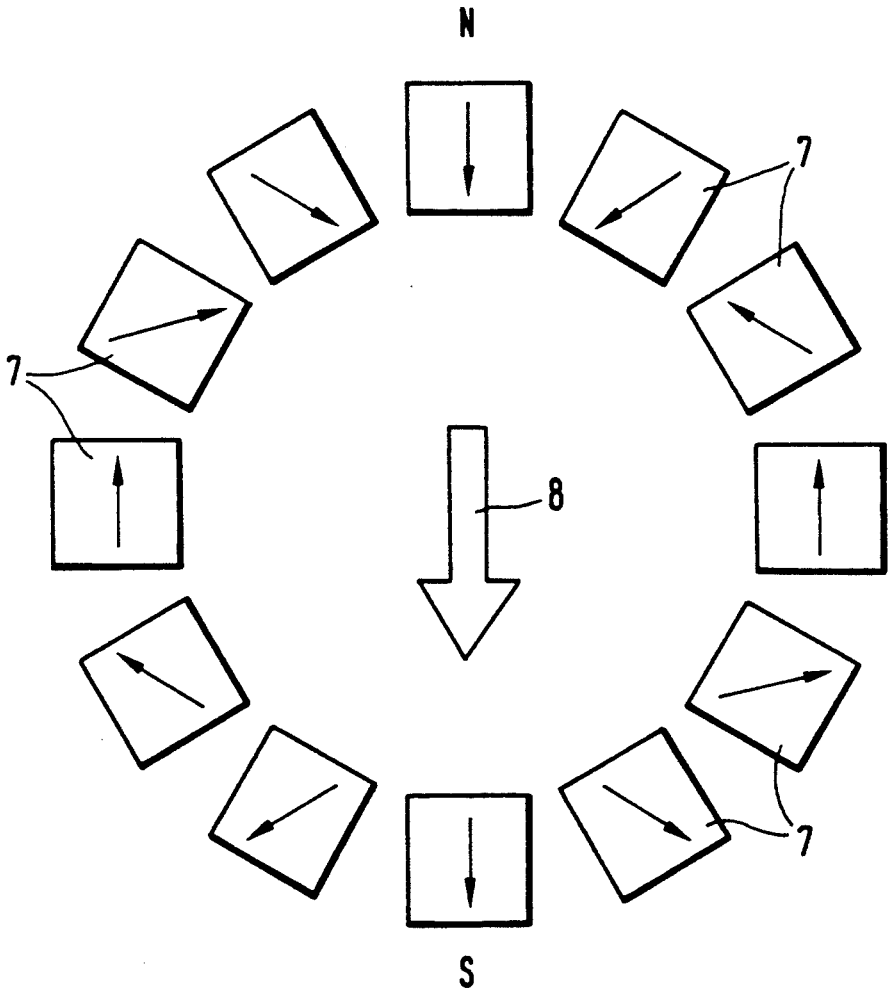
FIG. 5 shows a circular ring-shaped arrangement of a magnet system in accordance with the invention, having the magnetic field inside directed from top to bottom.

FIG. 5 shows the circular arrangement of magnetic blocks (7) made square in cross section in accordance with the invention. In this arrangement, one pole is formed by each six magnet blocks. The magnetic field is directed inwardly, and indeed running from top to bottom in the direction of the arrow (8). Such ring magnet systems having an inwardly directed magnetic field are employed primarily in tomographs, storage rings, etc., while magnet systems having an outwardly directed magnetic field find use primarily in magnetic separators, in particular drum-type magnetic separators.

Figure 6:
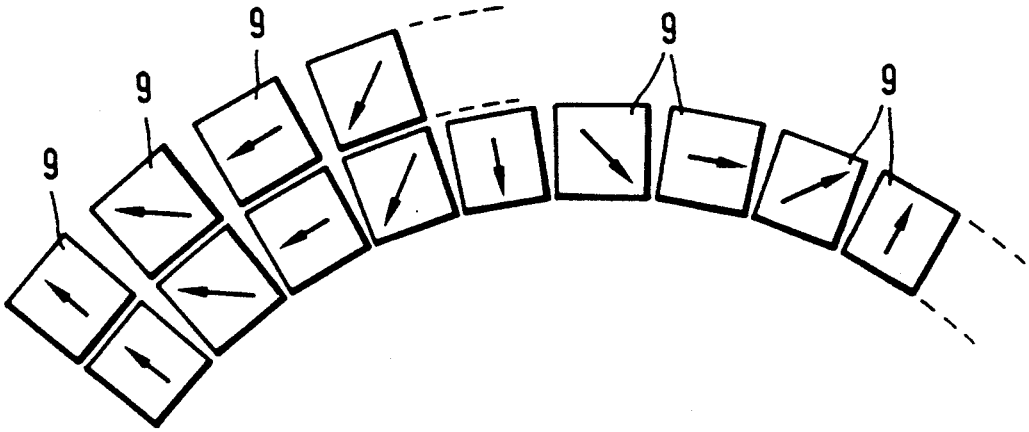
FIG. 6 shows a sectoral arrangement of a magnet system having two magnet blocks of equal square cross section arranged in rows one behind another.

In the magnet system illustrated in FIG. 6, the magnet blocks (9) are arranged in two circular ring-shaped rows, one behind another, and are made with equally large cross section. A corresponding enhancement of the magnetic field strength can be achieved very advantageously by means of these magnet blocks (9) arranged in two rows one behind another.

Figure 7:
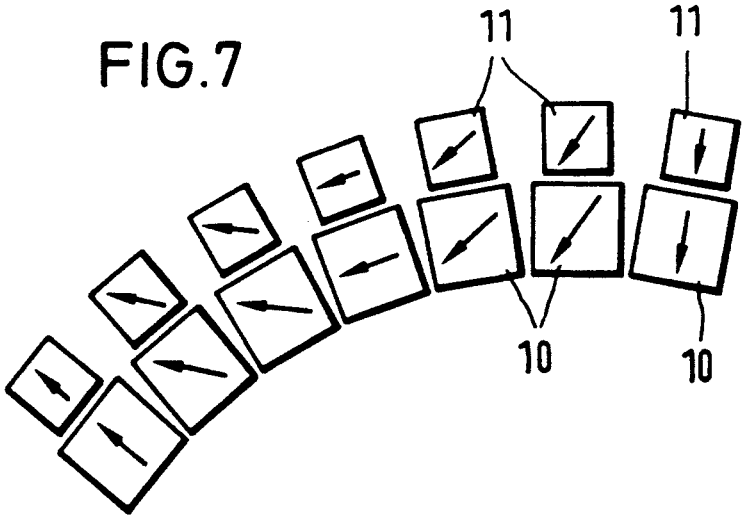
FIG. 7 shows a sectoral arrangement of a magnet system having two magnet blocks of unequally large cross section arranged in rows one behind another.

As FIG. 7 shows, under some circumstances it can also be desirable that, of the magnet blocks (10 and 11) arranged in two circular ring-shaped rows one behind another, the magnet blocks (10) of the inner row exhibit a larger square cross section in comparison with the magnet blocks (11) of the outer row. Under some circumstances, the outer row having magnet blocks (11) can also be interchanged with the inner row having magnet blocks (10), or, however, more than two rows having magnet blocks of equally large or unequally large cross sections can be assembled into a magnet system. This permits, in a very advantageous fashion, a continuous variation of the design of the magnet system with respect to the magnetic field strength, and thus of a substantial broadening of the possible uses of the magnet system made in accordance with the invention.

Figure 8:
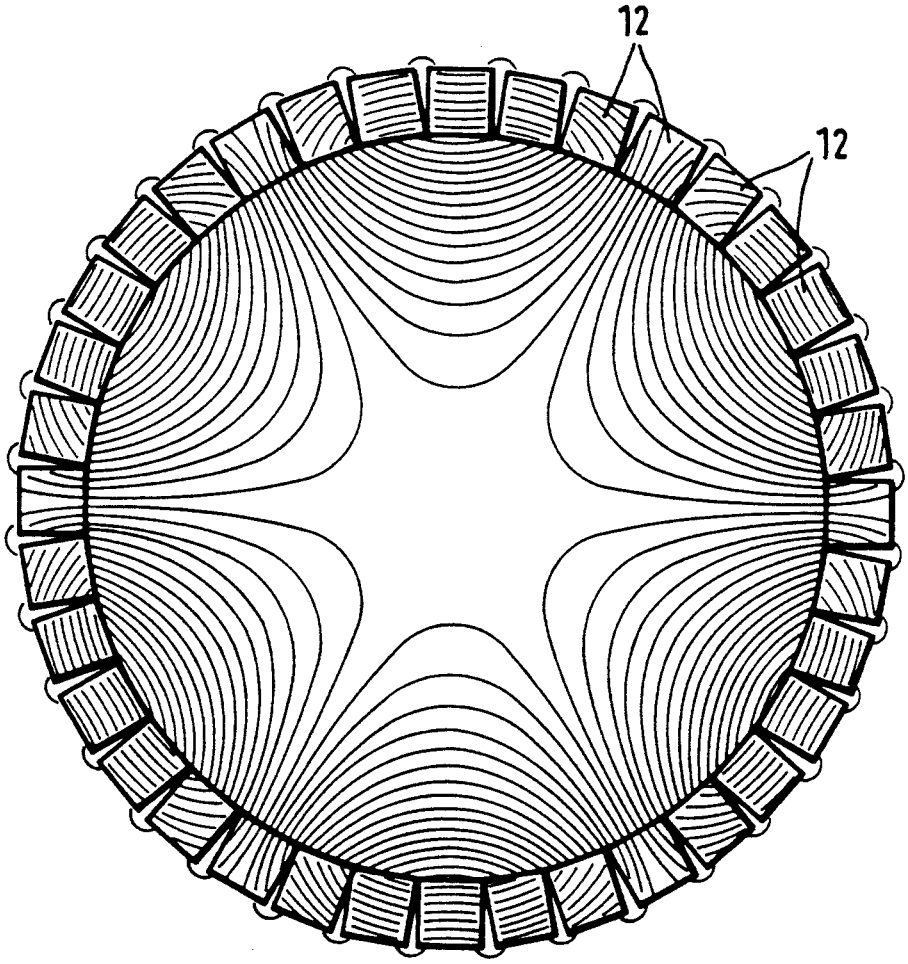
FIG. 8 shows a circular ring-shaped arrangement of magnet blocks, made square in cross section in accordance with the invention, having an inwardly directed hexapolar magnetic field.

Finally, as FIG. 8 shows, an inwardly directed, almost uniform or homogeneous magnetic field can be generated in accordance with the invention by means of a circular ring-shaped arrangement of magnet blocks (12) made square in cross section. Here the magnet blocks (12) are made relatively small in cross section, by which means a ring almost closed in itself is formed very advantageously and a magnet system having high efficiency is achieved. Moreover, all the magnet blocks illustrated in the figures of the drawing, made square in accordance with the invention, are permanent magnets.

The embodiments of the invention in which an exclusive property or privilege is claimed are defined as follows:

1. A magnet system for a magnetic separator comprising in combination:

a cylindrical foundation;

a plurality of homogeneously magnetized magnet blocks arranged about said cylindrical foundation in at least one annular row;

said magnet blocks being square in cross section and the magnetization directions of said magnet blocks being differently aligned relative to one another and relative to a radial line from the center of said annular row according to a predetermined mathematical formula, said magnet blocks being aligned according to the mathematical formula $\psi i = -n\phi i$, where $\psi i$ is the angle between the radial line and the magnetization direction of the magnet block, $\phi i$ is the angular location of the magnetic block relative to said radial line and n is a positive number, said magnet blocks having two different magnetization directions relative to their parallel side faces, each of said magnet blocks in said annular row being positioned with one of its faces in substantially tangential relation to said cylindrical foundation, those magnetic blocks having the same magnetization direction being positioned in 90° rotated positions relative to one another in said annular row, whereby said magnet blocks produce an outwardly directed magnetic field outside of said cylindrical foundation.

2. The magnet system of claim 1 wherein each of said magnet blocks have two pairs of parallel side faces defining a magnet block of predetermined longitudinal length and square cross section, some of said magnet blocks have a 90° magnetization direction relative to one pair of their parallel side faces and the remainder of said magnet blocks have a 60° magnetization direction relative to one pair of their parallel side faces, said magnet blocks being positioned in said annular row to provide 30° sequential differences in their magnetization directions by selective rotation about their longitudinal axes and by selective rotation in their longitudinal axes.

3. The magnet system of claim 1 wherein each of said magnet blocks have two pairs of parallel side faces, some of said magnet blocks have a 90° magnetization direction relative to one pair of their parallel side faces and the remainder of said magnet blocks have a 45° magnetization direction relative to one pair of their parallel side faces, said magnet blocks being positioned in said annular row to provide 45° sequential differences in their magnetization directions by selective rotation about their longitudinal axes.

* * * * *